US010036538B2

(12) United States Patent
Goldstein et al.

(10) Patent No.: US 10,036,538 B2
(45) Date of Patent: Jul. 31, 2018

(54) METHOD AND APPARATUS FOR UNIFORM ILLUMINATION OF A SURFACE

(71) Applicant: PHILIPS LIGHTING HOLDING B.V., Eindhoven (NL)

(72) Inventors: Peter Isaac Goldstein, Medford, MA (US); Eric Anthony Roth, Tyngsboro, MA (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 73 days.

(21) Appl. No.: 15/038,201

(22) PCT Filed: Nov. 13, 2014

(86) PCT No.: PCT/IB2014/066014
§ 371 (c)(1),
(2) Date: May 20, 2016

(87) PCT Pub. No.: WO2015/075608
PCT Pub. Date: May 28, 2015

(65) Prior Publication Data

US 2016/0290611 A1 Oct. 6, 2016

Related U.S. Application Data

(60) Provisional application No. 61/906,463, filed on Nov. 20, 2013.

(51) Int. Cl.
*F21V 21/14* (2006.01)
*F21V 23/00* (2015.01)
(Continued)

(52) U.S. Cl.
CPC ..... *F21V 21/14* (2013.01); *F21S 8/00* (2013.01); *F21V 5/04* (2013.01); *F21V 9/08* (2013.01);
(Continued)

(58) Field of Classification Search
CPC ..... F21S 8/00; F21S 8/046; F21S 8/03; F21S 8/032; F21S 8/033; F21V 21/14;
(Continued)

(56) References Cited

U.S. PATENT DOCUMENTS 4,126,210 A 11/1978 Martin
4,564,888 A 1/1986 Lewin et al.
(Continued)

FOREIGN PATENT DOCUMENTS

EP 1818607 A1 8/2007
EP 2116761 A1 11/2009
(Continued)

OTHER PUBLICATIONS

Bartenbach, "Description EP2116761", May 8, 2009, Patent Translate Powered by EPO and Google, pp. 1-6.*
(Continued)

*Primary Examiner* — Alan Cariaso
(74) *Attorney, Agent, or Firm* — Meenakshy Chakravorty

(57) ABSTRACT

Disclosed is a lighting system (10) that illuminates a surface (16) with a uniform illumination pattern (12). The lighting system includes a plurality of lighting units (14) that each emit a light beam that has a variable vertical illumination distribution and a variable horizontal illumination distribution. The intensity of each light beam is uniform in a central region of the horizontal illumination distribution, and non-uniform at each end of the horizontal illumination distribution. Similarly, the intensity of each light beam is uniform in a central region of the vertical illumination distribution, and largely non-uniform at each end of the vertical illumination distribution. The light beams overlap in the region of horizontal nonuniformity in order to create an illumination pattern that appears uniform.

20 Claims, 7 Drawing Sheets

(51) Int. Cl.

| | |
|---|---|
| ***F21V 5/04*** | (2006.01) |
| ***F21V 9/08*** | (2018.01) |
| ***F21S 8/00*** | (2006.01) |
| *F21Y 105/10* | (2016.01) |
| *F21Y 103/10* | (2016.01) |
| *F21Y 115/10* | (2016.01) |
| *F21Y 101/00* | (2016.01) |

(52) U.S. Cl.
CPC ..... *F21V 23/003* (2013.01); *F21Y 2101/00* (2013.01); *F21Y 2103/10* (2016.08); *F21Y 2105/10* (2016.08); *F21Y 2115/10* (2016.08)

(58) Field of Classification Search
CPC . F21V 5/04; F21V 9/08; F21V 23/003; F21Y 2103/10; F21Y 2105/10; F21Y 2115/10; F21Y 2101/00
See application file for complete search history.

(56) References Cited

U.S. PATENT DOCUMENTS

| | | | | |
|---|---|---|---|---|
| 4,954,935 | A | 9/1990 | Hammond et al. | |
| 5,008,791 | A | 4/1991 | Caferro | |
| 6,016,038 | A | 1/2000 | Mueller et al. | |
| 6,211,626 | B1 | 4/2001 | Lys et al. | |
| 6,773,135 | B1 * | 8/2004 | Packer | F21S 2/00 362/145 |
| 9,239,141 | B1 * | 1/2016 | Schertler | G09F 13/02 |
| 9,458,972 | B1 * | 10/2016 | Dong | F21V 7/0025 |
| 2003/0128632 | A1 | 7/2003 | Jongewaard et al. | |
| 2004/0090784 | A1 | 5/2004 | Ward | |
| 2007/0171631 | A1 * | 7/2007 | Davis | F21V 15/01 362/147 |
| 2008/0123057 | A1 | 5/2008 | Williamson | |
| 2008/0204888 | A1 * | 8/2008 | Kan | F21S 8/026 359/629 |
| 2009/0021933 | A1 | 1/2009 | Mayer et al. | |
| 2009/0296383 | A1 | 12/2009 | Valster et al. | |
| 2011/0038168 | A1 | 2/2011 | Schug | |
| 2011/0175533 | A1 | 7/2011 | Holman et al. | |
| 2013/0120974 | A1 * | 5/2013 | Swisha | F21V 33/006 362/147 |

FOREIGN PATENT DOCUMENTS

| | | | |
|---|---|---|---|
| EP | 2287640 | A2 | 2/2011 |
| EP | 2397875 | A2 | 12/2011 |
| WO | 2013141649 | A1 | 9/2013 |

OTHER PUBLICATIONS

ERCO, www.erco.com/products, "TFL Wallwasher Recessed Luminaires," Jan. 2012 Edition (6 Pages).

* cited by examiner

METHOD AND APPARATUS FOR UNIFORM ILLUMINATION OF A SURFACE

CROSS-REFERENCE TO PRIOR APPLICATIONS

This application is the U.S. National Phase application under 35 U.S.C. § 371 of International Application No. PCT/IB2014/066014, filed on Nov. 13, 2014, which claims the benefit of U.S. Provisional Patent Application No. 61/906,463, filed on Nov. 20, 2013. These applications are hereby incorporated by reference herein.

TECHNICAL FIELD

The present invention is directed generally to uniform surface illumination. More particularly, various inventive methods and apparatus disclosed herein relate to the illumination of a surface using overlapping illumination patterns having controlled non-uniformity.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

It is often desirable to illuminate a wall or other surface in a manner that appears visually uniform to an observer. A uniform light distribution is generally a pleasing and non-distracting type of surface lighting. However, gaps between multiple light sources result in a non-uniform illumination pattern with adjoining brighter and darker regions. A related problem is non-uniform illumination in the vertical direction resulting in further non-uniform illumination. As a result, part of the surface typically has a bright "hot spot" that runs along the horizontal length of the surface being illuminated. One solution is to use a wider illumination beam angle, but any improvement is typically not sufficient to result in uniform luminance.

It has previously been discovered that uniform illumination is achieved on a flat surface when the light's intensity distribution is proportional to $\cos^{-3}(\bullet)$, where • is the angle of the light measured relative to the surface normal. However, because most installations of lighting units involve more than one light source, it is difficult to align all of the light sources to meet the mathematical requirement for uniform illumination. For example, even if a lighting unit is properly installed, the fixtures/light sources will likely not ideally align, and manufacturing tolerances create a further practical limitation on ideal alignment. Accordingly, perfect alignment and uniformity is not a feasible solution for uniform luminance of a surface.

Thus, there is a need in the art to provide an illumination pattern to achieve a visually pleasing luminance over an extended object surface, such as a wall, when using multiple light sources or multiple fixtures that are not ideally or perfectly aligned.

SUMMARY

The present disclosure is directed to methods and apparatus for achieving a uniform luminance from a surface being illuminated by a plurality of light sources. For example, at least two light sources may be used to illuminate a surface wherein it is desired to provide the appearance to an observer that the surface has a uniform (or uniformly appearing) luminance. In view of the foregoing, various embodiments and implementations of the present invention are directed to an illumination pattern created by a plurality of light sources, each of which emits a beam having vertical and horizontal properties. In the vertical direction, the emitted light beam is largely uniform with a short region of controlled non-uniformity at the top and bottom of the light beam. In the horizontal region, the emitted light beam has a small uniform region at the center surrounded by large regions of controlled non-uniformity at the right and left sides of the light beam. Adjacent light beams are configured to overlap in the regions of controlled non-uniformity at the right and left sides of the emitted light beam.

Generally, in one aspect, a lighting system is configured to illuminate a surface with an illumination pattern. The lighting system includes a plurality of lighting units configured for positioning in spatially distributed relation to one another, wherein each of the plurality of lighting units emits a light beam with a vertical illumination distribution and a horizontal illumination distribution, and further wherein the emitted light beams yield the illumination pattern. The intensity of each of the light beams vary along the length of said horizontal illumination distribution, said intensity being largely uniform in a central region of the horizontal illumination distribution, and largely non-uniform at each end of the horizontal illumination distribution. Further, the intensity of each of said light beams vary along the length of said vertical illumination distribution, said intensity being largely uniform in a central region of the vertical illumination distribution, and largely non-uniform at each end of the vertical illumination distribution. Each of the plurality of lighting units comprises a plurality of LED-based light sources.

In some embodiments, the length of the central region of uniform intensity along said horizontal illumination distribution is shorter than the combined lengths of non-uniform intensity at the two ends of the horizontal illumination distribution.

In some embodiments, the length of the central region of uniform intensity along said vertical illumination distribution is greater than the combined lengths of non-uniform intensity at the two ends of the vertical illumination distribution.

In some embodiments, the largely non-uniform intensity of at least one end of the horizontal illumination distribution of a light beam emitted by a first lighting unit overlaps with the largely non-uniform intensity of at least one end of the horizontal illumination distribution of a light beam emitted by an adjacent lighting unit. The intensity of light within the region of overlap is similar to the intensity of the central region of the horizontal illumination distribution emitted by said first lighting unit, and similar to the intensity of the central region of the horizontal illumination distribution emitted by said adjacent lighting unit.

In some embodiments, the length of the central region of uniform intensity along said vertical illumination distribution is approximately 70% to 90% of the total vertical illumination distribution.

In some embodiments, the length of the central region of uniform intensity along said horizontal illumination distribution is approximately 40% to 80% of the total horizontal illumination distribution.

Generally, in one aspect, a lighting unit is configured to illuminate a surface with an illumination pattern. The lighting unit includes a plurality of LED-based light sources positioned in spatially distributed relation to one another, wherein each of plurality of light sources emits a light beam having a vertical illumination distribution and a horizontal illumination distribution (30), and further wherein the emitted light beams yield said illumination pattern. The intensity of each of said light beams vary along the length of said horizontal illumination distribution, said intensity being largely uniform in a central region of the horizontal illumination distribution, and largely non-uniform at each end of the horizontal illumination distribution. Further, the intensity of each of said light beams vary along the length of said vertical illumination distribution, said intensity being largely uniform in a central region of the vertical illumination distribution, and largely non-uniform at each end of the vertical illumination distribution.

Generally, in one aspect, a method for illuminating a surface with an illumination pattern includes the step of providing a plurality of lighting units configured for positioning in spatially distributed relation to one another, wherein each of plurality of lighting units emits a light beam having a vertical illumination distribution and a horizontal illumination distribution, and further wherein the emitted light beams yield the illumination pattern. The intensity of each of said light beams vary along the length of said horizontal illumination distribution, said intensity being largely uniform in a central region of the horizontal illumination distribution, and largely non-uniform at each end of the horizontal illumination distribution. Further, the intensity of each of said light beams vary along the length of said vertical illumination distribution, said intensity being largely uniform in a central region of the vertical illumination distribution, and largely non-uniform at each end of the vertical illumination distribution.

In some embodiments, the method further includes the step of spatially distributing two or more of said plurality of lighting units in relation to one another.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Applicants have recognized and appreciated that it would be beneficial to provide uniform illumination of a surface being illuminated by a plurality of light sources. For example, at least two light sources may be used to illuminate a surface wherein it is desired to provide the appearance to an observer that the surface has a uniform (or uniformly appearing) illumination.

In view of the foregoing, various embodiments and implementations of the present invention are directed to a uniformly appearing illumination pattern created by a plurality of light sources, each of which emits a beam having vertical and horizontal properties. In the vertical direction, the emitted light beam is largely uniform with a short region of controlled non-uniformity at the top and bottom of the light beam. In the horizontal region, the emitted light beam has a small uniform region at the center surrounded by large regions of controlled non-uniformity at the right and left sides of the light beam. Adjacent light beams are configured to overlap in the regions of controlled non-uniformity at the right and left sides of the emitted light beam.

Figure 1:
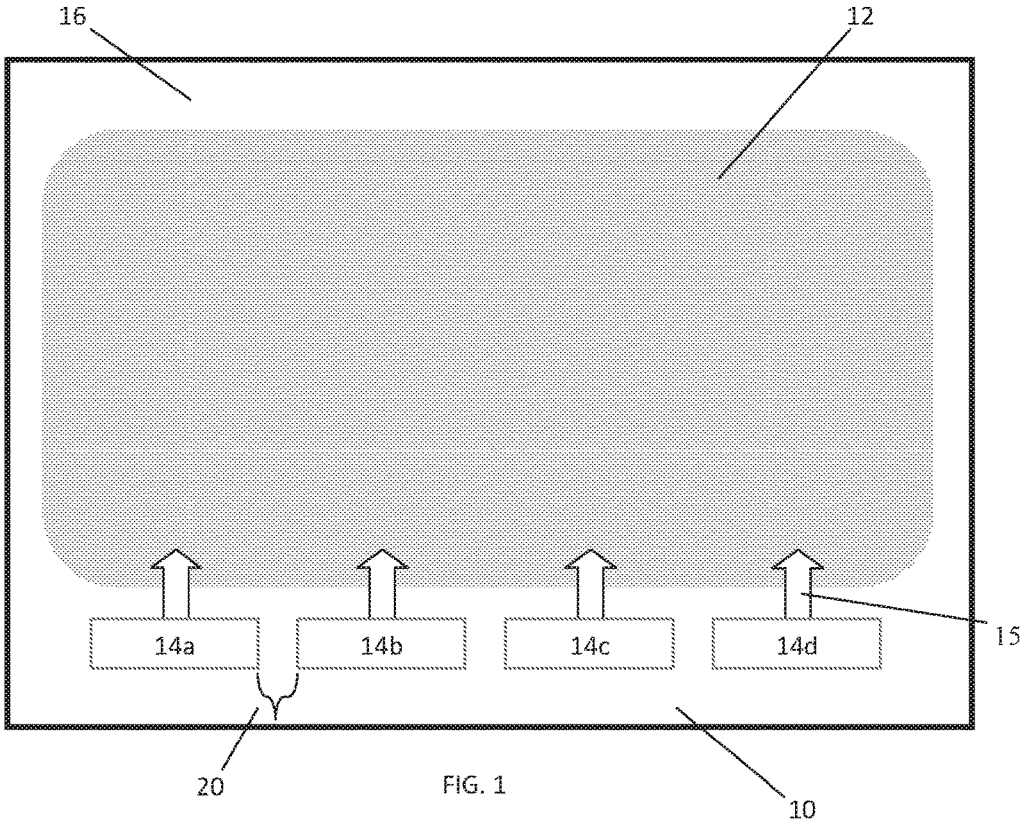
FIG. 1 illustrates a surface with an illumination pattern that appears substantially uniform in accordance with an embodiment.

Referring now to the drawings, in FIG. 1 there is shown one embodiment of a lighting system 10 including a plurality of lighting units 14 (14*a*, 14*b*, 14*c*, and 14*d*) oriented to emit an illumination pattern 12 on surface 16 made up of one or more light beams 15 from each lighting unit. In some embodiments each lighting unit 14 generally includes a plurality of LED-based light sources 18. The LED-based light source may have one or more LEDs, including an array of LEDs in a linear, two-dimensional, or three-dimensional configuration. The light source can be driven to emit light of a predetermined character (i.e., color intensity, color temperature, etc.). Many different numbers and various types of light sources (all LED-based light sources, LED-based and non-LED-based light sources alone or in combination, etc.) adapted to generate radiation of a variety of different colors may be employed in the lighting unit 14. For example, in some embodiments, lighting unit 14 includes LEDs of two or more different colors. Accordingly, spatial orientation of the lighting units may also result in adjustment of the color or color temperature of emitted light.

In the embodiment illustrated in FIG. 1, the horizontal direction with respect to an observer viewing the surface 16 is left/right in the plane of the paper and the vertical direction of the wall surface is a horizontal plane also in the plane of the paper. In this embodiment the lighting units 14 are in the form of an M×N array of lighting units, wherein the N lighting units are disposed in the horizontal direction side-by-side with a finite separation distance 20 between each adjacent lighting unit. In this embodiment there is a single row of light sources, thus M is equal to one and N is equal to or greater than two. In this embodiment each lighting unit 14 has an illumination footprint 22 (see FIG. 2) that has a vertical-to-horizontal aspect ratio that is equal to or greater than one (1) such that the illumination footprint 22 on the surface 16 is substantially rectangular in shape.

Figure 3:
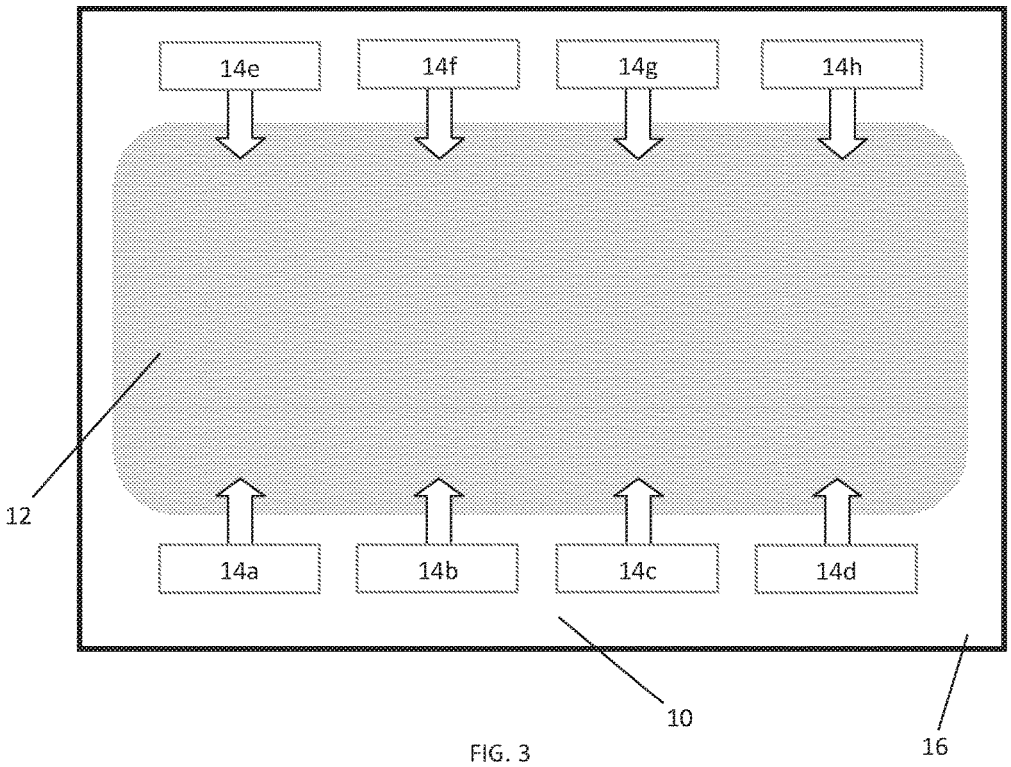
FIG. 3 illustrates a surface illuminated with a plurality of light sources in accordance with an embodiment.

Although FIG. 1 illustrates an M×N array with a configuration of 1×4, other arrays and configurations are possible. FIG. 3, for example, illustrates an M×N array with a configuration of 2×4, with lighting units 14*a*, 14*b*, 14*c*, and 14*d* emitting light beams in an upwardly direction, and lighting units 14*e*, 14*f*, 14*g*, and 14*h* emitting light beams in a downwardly direction. Both M and N can be modified as necessary to achieve a desired overall illumination pattern.

Figure 2:
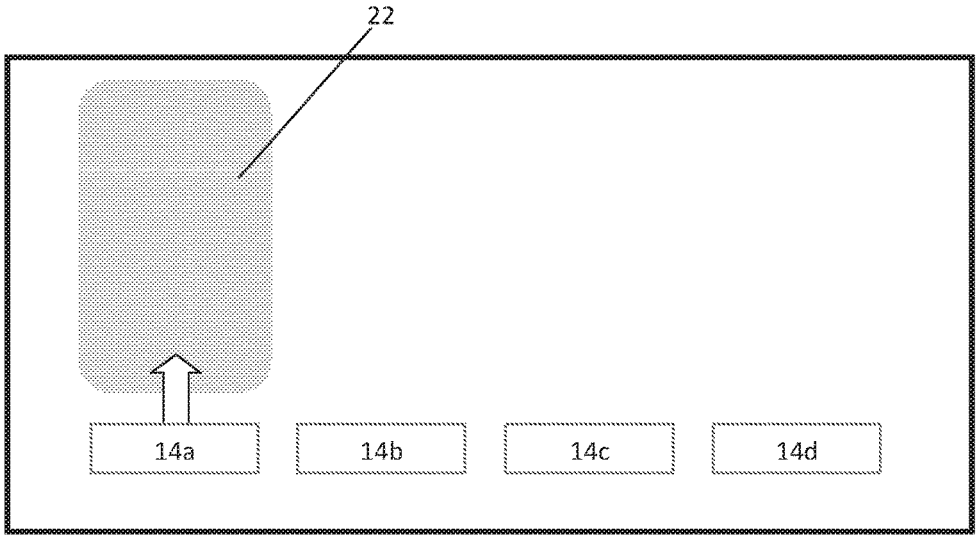
FIG. 2 illustrates a surface with a single illumination footprint in accordance with an embodiment.
Figure 4:
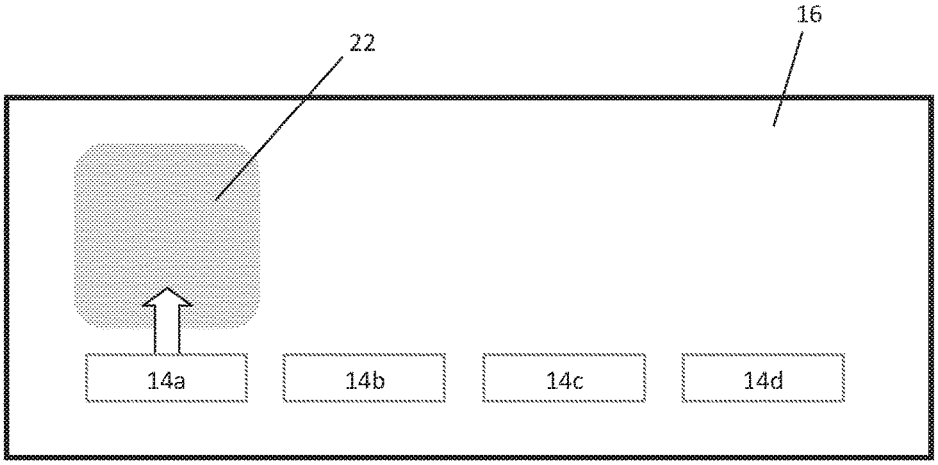
FIG. 4 illustrates a surface with a single illumination footprint in accordance with an embodiment.

Further, although FIGS. 1 and 2 illustrate lighting units 14 with an illumination footprint 22 that has a vertical-to-horizontal aspect ratio that is equal to or greater than one (1) such that the illumination footprint 22 on the surface 16 is substantially rectangular in shape, many other shapes, sizes, and configurations are possible. For example, in FIG. 4, lighting unit 14*a* has an illumination footprint 22 that is substantially square in shape.

Figure 5:
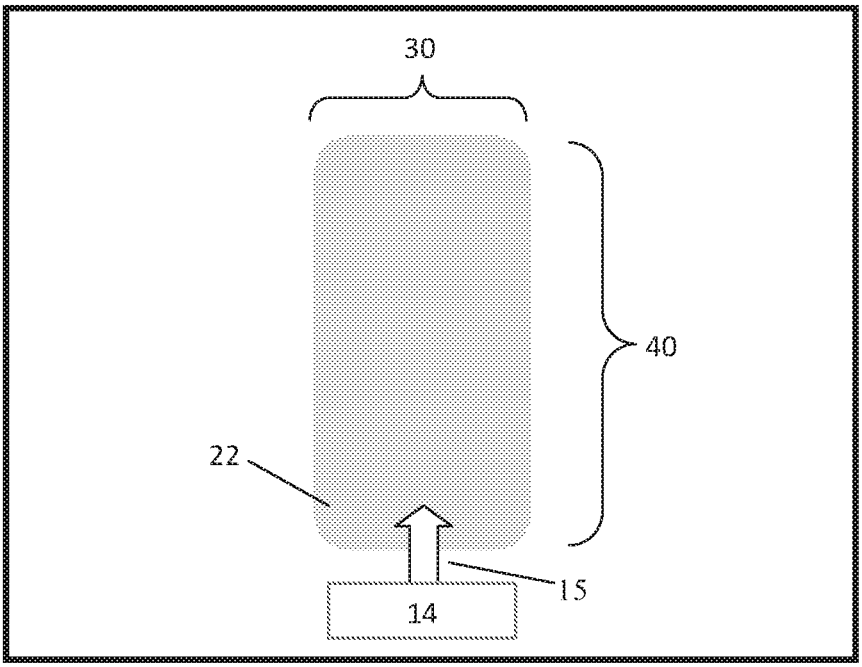
FIG. 5 illustrates a surface with a single illumination footprint having a vertical illumination distribution and a horizontal illumination distribution in accordance with an embodiment.
Figure 7:
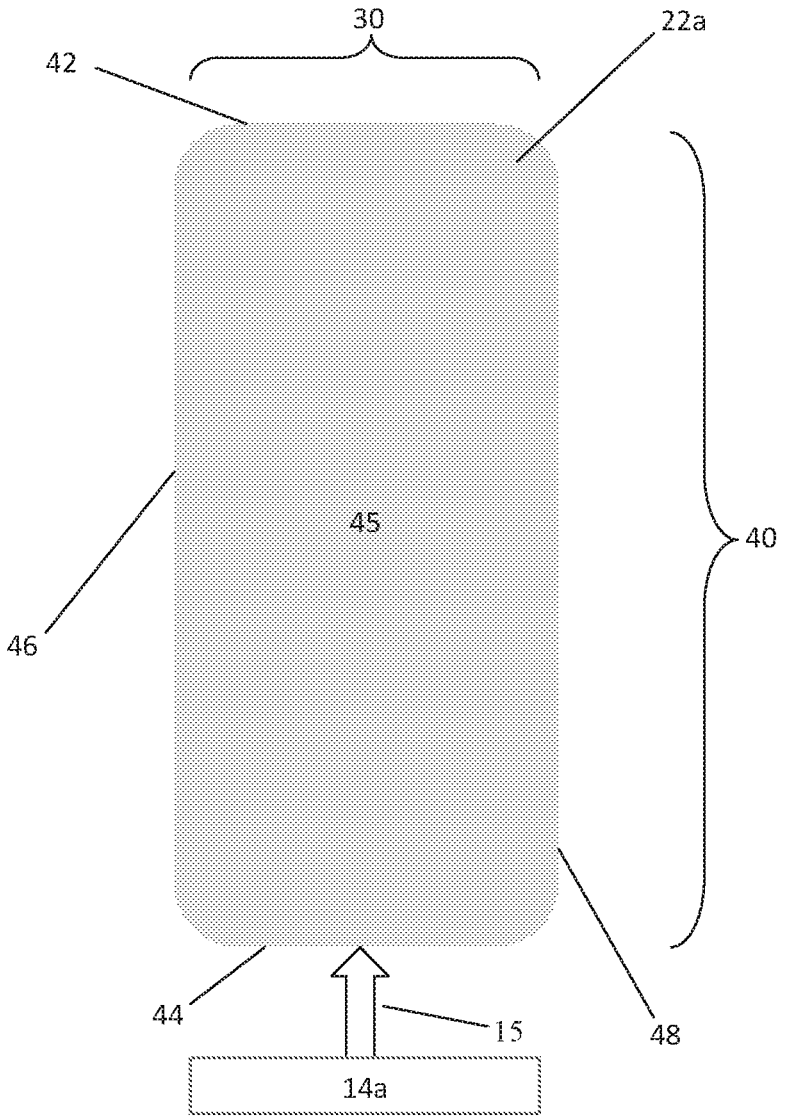
FIG. 7 illustrates an illumination footprint having a vertical illumination distribution and a horizontal illumination distribution in accordance with an embodiment.

In order to achieve a uniformly appearing illumination pattern 12 on surface 16, lighting unit 14 is configured to emit a light beam 15 with a vertical illumination distribution or direction 40 and a horizontal illumination distribution or direction 30 to create an illumination footprint 22, as illustrated in FIGS. 5 and 7. In some embodiments, light beam 15 emitted from lighting unit 14 is generated by a LED-based light source 18, which may have one or more LEDs, including an array of LEDs in a linear, two-dimensional, or three-dimensional configuration. In the vertical illumination distribution 40, the emitted light beam is configured to be largely uniform in the center 45 with a short region of controlled non-uniformity at the top 42 and bottom 44 of the light beam. In the horizontal illumination distribution 30, the emitted light beam is configured to have a small uniform region at the center 45 surrounded by large regions of controlled non-uniformity at the right side 48 and left side 46 of the light beam.

Figure 8:
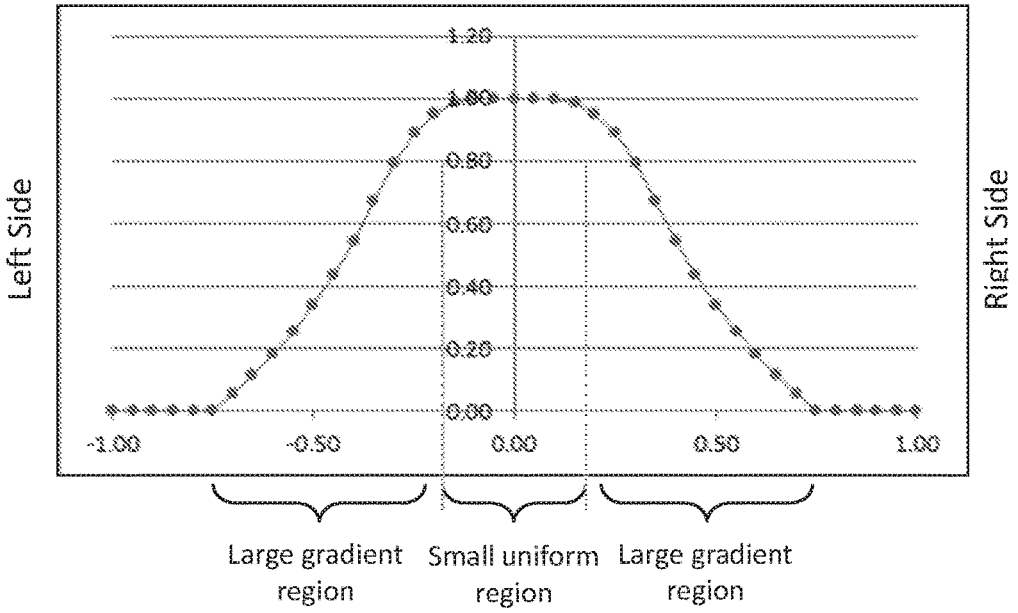
FIG. 8 is a graph of varying light beam intensity along the horizontal illumination distribution of a lighting system in accordance with an embodiment.

In some embodiments, as illustrated in the graph in FIG. 8, a light beam 15 emitted by lighting unit 14 has a horizontal illumination distribution 30 in which the emitted light beam is configured to have a small uniform region at the center 45 surrounded by large regions of controlled non-uniformity at the right side 48 and left side 46 of the light beam. The X-axis of the graph in FIG. 8 is the distance to the left and right from a central point, with the central point being the center of the illumination footprint 22 of lighting unit 14, normalized from 0 to 1 with a value of 1 being the extreme outer boundary of the illumination footprint. The Y-axis of the graph in FIG. 8 is the illumination intensity of the light beam 15 emitted by lighting unit 14, normalized from 0 to 1, with a value of 1 being the greatest intensity of the emitted light beam.

In the embodiment illustrated in FIG. 8, the horizontal illumination distribution 30 of the illumination footprint 22 has a central "small uniform region" comprising between about 40% to 80% of the horizontal illumination profile with normalized illumination intensity values in a range of between about 0.6 and 1.0. The horizontal illumination distribution 30 of the illumination footprint 22 also has, at its left and right sides, a "large gradient region" where the normalized illumination intensity values quickly decrease from the central region value to a value of zero at the extreme outer boundaries of the illumination footprint.

Figure 9:
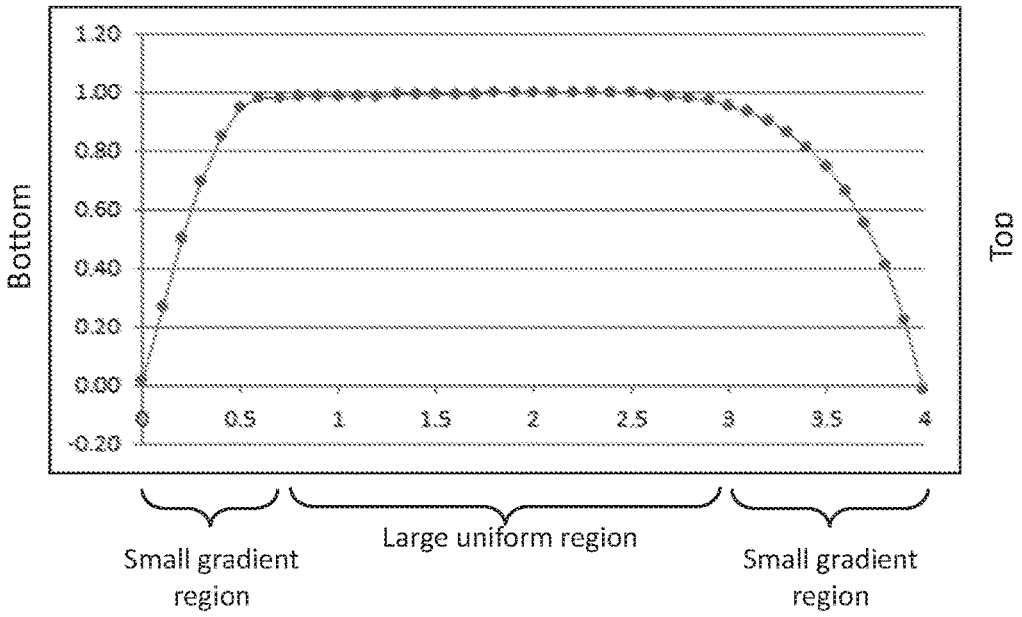
FIG. 9 is a graph of varying light beam intensity along the vertical illumination distribution of a lighting system in accordance with an embodiment.

In some embodiments, as illustrated in the graph in FIG. 9, a light beam 15 emitted by lighting unit 14 has a vertical illumination distribution 40 in which the emitted light beam is configured to be largely uniform in the center 45 with a short region of controlled non-uniformity at the top 42 and bottom 44 of the light beam. The X-axis of the graph in FIG. 9 is the distance vertical distance (0 to 4 meters) from the bottom to the top of the illumination footprint 22 of lighting unit 14. The Y-axis of the graph in FIG. 9 is the illumination intensity of the light beam 15 emitted by lighting unit 14, normalized from 0 to 1, with a value of 1 being the greatest intensity of the emitted light beam.

In the embodiment illustrated in FIG. 9, the vertical illumination distribution 40 of the illumination footprint 22 has a large central, uniform region comprising between about 70% to 90% of the vertical illumination profile with normalized illumination intensity values in a range of between about 0.8 and 1.0. The vertical illumination distribution 40 of the illumination footprint 22 also has, at both its top and bottom edges, a small gradient region where the normalized illumination intensity values quickly decrease from the central region value to a value of zero at the extreme outer boundaries of the illumination footprint.

Figure 6:
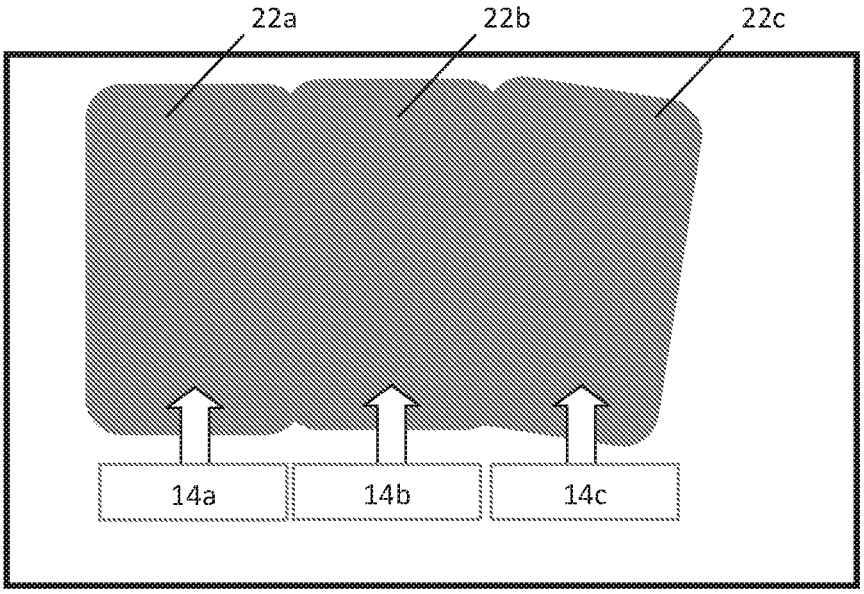
FIG. 6 illustrates a surface with an illumination pattern that appears substantially uniform in accordance with an embodiment.

In some embodiments, adjacent light beams are configured to overlap in the regions of controlled non-uniformity at the right and left sides of the emitted light beam. For example, as shown in FIG. 6, the light beam emitted by lighting unit 14*a* results in an illumination footprint 22*a* that overlaps at its right edge with the left edge of the illumination footprint 22*b* created by a light beam emitted by lighting unit 14*b*. Similarly, the light beam emitted by lighting unit 14*b* results in an illumination footprint 22*b* that overlaps at its right edge with the left edge of the illumination footprint 22*c* created by a light beam emitted by lighting unit 14*c*. In some embodiments, the overlap of controlled non-uniformity between adjacent light beams or illumination footprints accommodates misalignment that may occur between adjacent lighting units. For example, although lighting unit 14*c* in FIG. 6 is misaligned as indicated by the tilt of the illumination footprint 22*c* compared to illumination footprint 22*b*, the overlapping gradient regions of illumination footprint 22*b* and illumination footprint 22*c* results in a visually uniform illumination pattern. In some embodiments, as a result of this overlap, the intensity of the light within the region of overlap will be similar or identical to the intensity of the central region of the horizontal illumination distribution emitted by each individual lighting unit.

Figure 12:
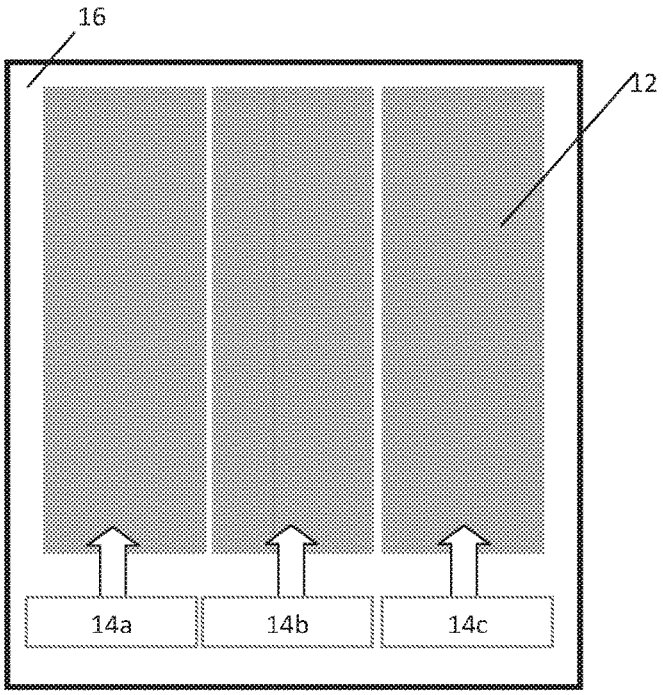
FIG. 12 illustrates a surface with an illumination pattern that appears substantially non-uniform in accordance with an embodiment.

However, as shown in FIG. 12 for example, the horizontal spacing of adjacent lighting units can exceed a distance such that there is no overlap of the regions of controlled non-uniformity at the right and left sides of the emitted light beam. In such a circumstance, non-uniformities can begin to appear in the overall illumination footprint. To repair the non-uniformity, one or more of the lighting units 14 can be repositioned such that there is overlap of the regions at the right and left sides of the emitted light beam, or another lighting unit can be added to the lighting system to cover the region of non-uniformity.

As an example of overlapping, Table 1 illustrates the overlap of the illumination footprint 22 of lighting units 14*a* with 14*b*, 14*b* with 14*c*, and 14*c* with 14*d* in a simulated lighting system with a surface 16 being illuminated. In the region of surface 16 where there is a desire to have a uniform illumination pattern (between 1.0 and 3.5 meters), the total intensity of light beams striking the surface adds up to a normalized value of 1. At each location, the light beams striking surface 16 are composed of either a light beam entirely from a single lighting unit, or a composite of light beams from two overlapping lighting units. Although Table 1 illustrates a lighting system with four lighting units, the lighting system may include fewer than four or more than four lighting units.

TABLE 1

| | X Coordinate (meters) | | | | | | | | | |
|---|---|---|---|---|---|---|---|---|---|---|
| | 0.00 | 0.50 | 1.00 | 1.50 | 2.00 | 2.50 | 3.00 | 3.50 | 4.00 | 4.50 |
| Lighting Unit 14a | 0 | 0.327 | 1.000 | 0.327 | 0 | | | | | |
| Lighting Unit 14b | | | 0 | 0.673 | 1.000 | 0.0477 | 0 | | | |
| Lighting Unit 14c | | | | | 0 | 0.9523 | 0.7948 | 0 | | |
| Lighting Unit 14d | | | | | | 0 | 0.2052 | 1.000 | 0.4537 | 0 |
| Sum of Lighting Units | 0 | 0.327 | 1 | 1 | 1 | 1 | 1 | 1 | 0.4537 | 0 |

Figure 10:
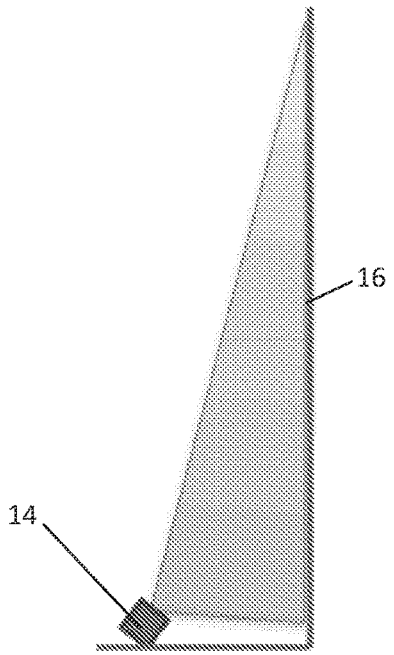
FIG. 10 illustrates the illumination of a surface 16 with a lighting unit in accordance with an embodiment.

In some embodiments, such as the embodiment illustrated in FIG. 10, a surface 16 is illuminated from a lighting unit 14 which is effectively a point source. The intensity of light emitted from the light source 18 and illuminating points along the surface 16 is a function of the linear angle of the point source to the surface. Accordingly, the illumination on surface 16 is a function of the location of the light on the surface, its distance from the light source, and its orientation angle. The illumination on a flat surface is related to intensity from a light source, therefore, according to the following formula:

$$E = \frac{I * \cos^3(\theta)}{d^2}$$

where illumination "E" has units of lumens per square meter, intensity "I" has units of lumens per steradians, and the distance "d" has units of meters. The angle "•" is measured from the surface's surface normal and the distance "d" is measured as projected along the surface's normal vector. If the angles are measured in terms of orthogonal horizontal and vertical components, $\bullet_h$ and $\bullet_v$, then the total linear angle, •, is:

$$\theta = \arccos(\cos(\theta_h) * \cos(\theta_v))$$

Figure 11:
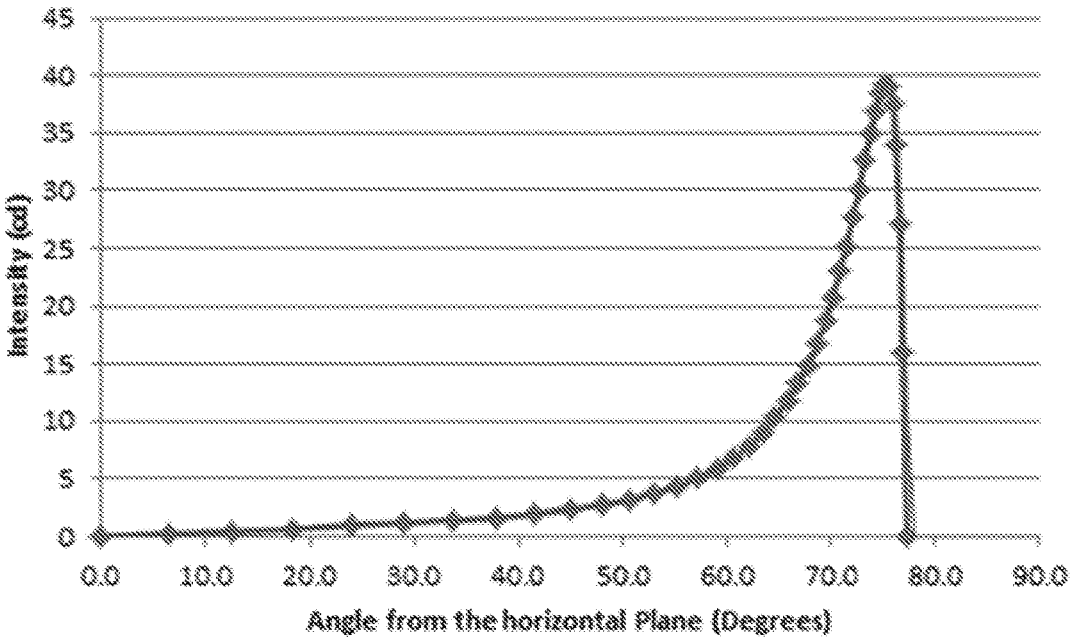
FIG. 11 is a graph of varying light beam intensity along the vertical illumination distribution of a lighting system in accordance with an embodiment.

As a result, for example, illustrated in FIG. 11 is a graph of light beam intensity distribution from a single lighting unit 14 along a vertical plane which achieves vertical near-uniformity on the surface. An illumination footprint 22 of lighting unit 14 is creates such that the intensity of the emitted light increases as the angle from the horizontal plane increases. At a certain point, for example 75 degrees in the graph in FIG. 11, the intensity of the emitted light decreases rapidly to zero. In some embodiments, the horizontal angle is the angle of light traveling from a single lighting unit 14 toward the surface 16 measured relative to a vertical plane passing through the center of the surface and through the lighting unit. The horizontal angle is a linear angle that only has a horizontal component.

In some embodiments, the illumination footprint 22 created by a lighting unit 14 may vary slightly within the vertical direction 40 and/or the horizontal direction 30. This variation can result from manufacturing errors or tolerances, from misalignment, or other inadvertent or unavoidable circumstances. In some cases, the variation may be as much as 0.6 (relative to a normalized maximum value of 1.0). However, the human eye and brain often will not detect these variations, especially in the central region of the vertical direction 40 and/or the horizontal direction 30 of illumination footprint 22.

In some embodiments, the lighting system 10 is composed of a plurality of LED-based light sources 18 within a single lighting unit 14. In this embodiment, the LED-based light sources 18 each emit a light beam that has a vertical illumination distribution (40) and a horizontal illumination distribution (30). As described above, the intensity of each of the light beams can vary along the length of the horizontal illumination distribution, with the intensity of the light beam being largely uniform in a central region and largely non-uniform at each end. Further, the intensity of each of the light beams can vary along the length of the vertical illumination distribution, with the intensity being largely uniform in the central region and largely non-uniform at each end.

Figure 13:
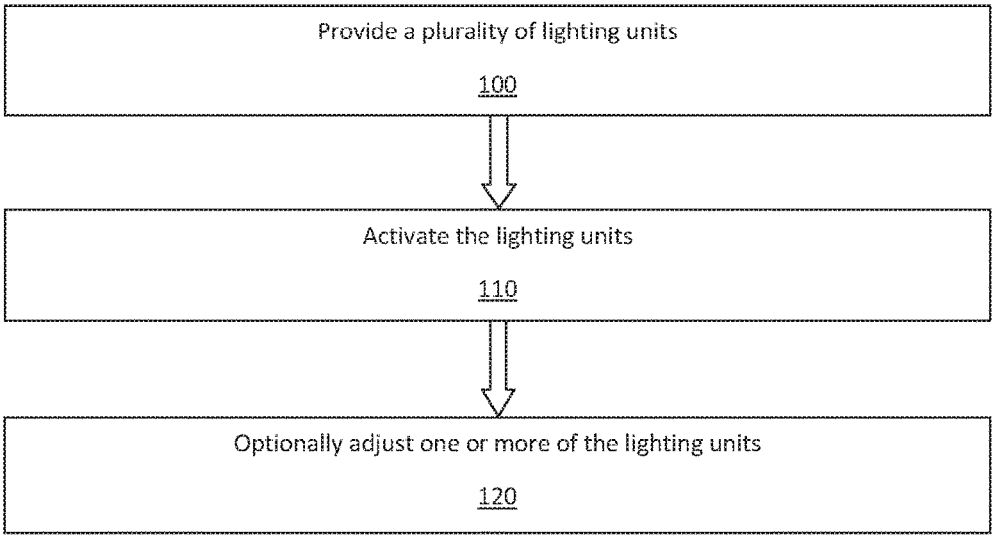
FIG. 13 is a flow chart of a method for uniformly illuminating a surface in accordance with an embodiment.

According to another aspect, as depicted in the flow chart in FIG. 13, is a method of illuminating a surface 16 with an illumination pattern 12. In an initial step 100, a plurality of lighting units 14 are provided. The two or more lighting units 14 can be, for example, independent lighting units 14 or can be components of a single lighting system 10. The two or more lighting units 14 can be positioned in spatially distributed relation to one another, and each of the lighting units can include, for example, a plurality of LED-based light sources 18. The light beams emitted by the lighting units 14 combine to yield the overall illumination pattern. As described above, each of the light beams emitted by the lighting units have a vertical illumination distribution 40 and a horizontal illumination distribution 30.

Further, in some embodiments as described above, the horizontal illumination distribution varies along its length with a central region of uniform intensity that is shorter than the combined lengths of non-uniform intensity at the two ends of the horizontal illumination distribution. Similarly, the vertical illumination distribution varies along its length with a central region of uniform intensity that is greater than the combined lengths of non-uniform intensity at the two ends of the vertical illumination distribution.

In some embodiments of the method, in order to improve the uniform appearance of the lighting system the non-uniform intensity of one end of the horizontal illumination distribution of a light beam overlaps with the non-uniform intensity of one end of the horizontal illumination distribution of a light beam emitted by an adjacent lighting unit. As a result, the combined intensity of the light within this region of overlap is similar to the intensity of the central region of the horizontal illumination distribution emitted by each adjacent lighting unit, thereby resulting in uniform appearance.

In step 110 of the method, two or more of the plurality of lighting units are activated to create the illumination pattern 12. In step 120, depending on the uniformity or non-uniformity of the illumination pattern, one or more lighting units 14 within the system can be rotated, angled, or otherwise adjusted in relation to another lighting unit in order to improve the uniformity of the illumination pattern. As another example, the intensity, angle, or color of the light beam 15 emitted by the lighting unit can similarly be adjusted.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Reference numerals appearing between parentheses in the claims, if any, are provided merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, asset forth in the United States Patent Office Manual of Patent Examining Procedures, Section 2111.03.

The invention claimed is:

1. A lighting system configured to illuminate a surface with an illumination pattern, the system comprising:

a plurality of lighting units configured for positioning in spatially distributed relation to one another, wherein each of the plurality of lighting units emits a light beam that creates an illumination footprint on the surface, the illumination footprint having a vertical illumination distribution and a horizontal illumination distribution, and further wherein the emitted light beams collectively yield said illumination pattern;

wherein the intensity of an illumination footprint created on the surface by each of said light beams varies along a length of said horizontal illumination distribution, with normalized illumination intensity values being in a range of between about 0.6 and 1.0 in a central region comprising about 40% to 80% of the horizontal illumination distribution, and less uniform at each end of the horizontal illumination distribution; and wherein the intensity of an illumination footprint created on the surface by each of said light beams varies along a length of said vertical illumination distribution, with normalized illumination intensity values in a range of between about 0.8 and 1.0 in a central region comprising about 70% to 90% of the vertical illumination distribution, and less uniform at each end of the vertical illumination distribution.

2. The lighting system of claim 1, wherein a length of the central region of uniform intensity along said horizontal illumination distribution is shorter than the combined lengths of less uniform intensity at the two ends of the horizontal illumination distribution.

3. The lighting system of claim 1, wherein a length of the central region of uniform intensity along said vertical illumination distribution is greater than the combined lengths of less uniform intensity at the two ends of the vertical illumination distribution.

4. The lighting system of claim 1, wherein each of said plurality of lighting units comprises a plurality of LED-based light sources.

5. The lighting system of claim 1, wherein the less uniform intensity of at least one end of the horizontal illumination distribution of a light beam emitted by a first lighting unit overlaps with the less uniform intensity of at least one end of the horizontal illumination distribution of a light beam emitted by an adjacent lighting unit.

6. The lighting system of claim 1, wherein the intensity of light within the region of overlap is similar to the intensity of the central region of the horizontal illumination distribution emitted by said first lighting unit, and similar to the intensity of the central region of the horizontal illumination distribution emitted by said adjacent lighting unit.

7. The lighting system of claim 1, wherein the less uniform intensities of respective ends of the horizontal illumination distributions of adjacent lighting units of the plurality of lighting units overlap such that, in at least a majority of the overlap, the less uniform intensities of the respective ends add to form the 1.0 normalized illumination intensity value.

8. A lighting unit configured to illuminate a surface with an illumination pattern, the lighting unit comprising:

a plurality of LED-based light sources positioned in spatially distributed relation to one another, wherein each of plurality of light sources emits a light beam that creates an illumination footprint on the surface, the illumination footprint having a vertical illumination distribution and a horizontal illumination distribution, and further wherein the emitted light beams collectively yield said illumination pattern;

wherein the intensity of an illumination footprint created on the surface by each of said light beams varies along a length of said horizontal illumination distribution, said intensity being more uniform in a central region comprising about 40% to 80% of the horizontal illumination distribution than at each end of the horizontal illumination distribution; and wherein the intensity of an illumination footprint created on the surface by each of said light beams varies along a length of said vertical illumination distribution, said intensity being more uniform in a central region comprising about 70% to 90% of the vertical illumination distribution than at each end of the vertical illumination distribution.

9. The lighting unit of claim 8, wherein a length of the central region of uniform intensity along said horizontal illumination distribution is shorter than the combined lengths of less uniform intensity at the two ends of the horizontal illumination distribution.

10. The lighting unit of claim 8, wherein a length of the central region of uniform intensity along said vertical illumination distribution is greater than the combined lengths of less uniform intensity at the two ends of the vertical illumination distribution.

11. The lighting unit of claim 8, wherein the less uniform intensity of at least one end of the horizontal illumination distribution of a light beam emitted by a first light source overlaps with the less uniform intensity of at least one end of the horizontal illumination distribution of a light beam emitted by an adjacent light source.

12. The lighting unit of claim 11, wherein the intensity of light within the region of overlap is similar to the intensity of the central region of the horizontal illumination distribution emitted by said first light source, and similar to the intensity of the central region of the horizontal illumination distribution emitted by said adjacent light source.

13. The lighting unit of claim 8, wherein respective ends of the horizontal illumination distributions of adjacent light sources of the plurality of LED-based light sources overlap such that, in at least a majority of the overlap, the respective ends add to form the 1.0 normalized illumination intensity value.

14. A method for illuminating a surface with an illumination pattern, the method comprising the steps of:

providing a plurality of lighting units configured for positioning in spatially distributed relation to one another, wherein each of plurality of lighting units emits a light beam that creates an illumination footprint on the surface, the illumination footprint having a vertical illumination distribution and a horizontal illumination distribution, and further wherein the emitted light beams collectively yield the illumination pattern;

wherein the intensity of an illumination footprint created on the surface by each of said light beams varies along a length of said horizontal illumination distribution, with normalized illumination intensity values being in a range of between about 0.6 and 1.0 in a central region comprising about 40% to 80% of the horizontal illumination distribution, and less uniform at each end of the horizontal illumination distribution;

wherein the intensity of each of said light beams vary along a length of said vertical illumination distribution, said intensity being more uniform in a central region of the vertical illumination distribution than at each end of the vertical illumination distribution.

15. The method of claim 14, further comprising the step of spatially distributing two or more of said plurality of lighting units in relation to one another.

16. The method of claim 14, wherein a length of the central region of uniform intensity along said horizontal illumination distribution is shorter than the combined lengths of less uniform intensity at the two ends of the horizontal illumination distribution.

17. The method of claim 14, wherein a length of the central region of uniform intensity along said vertical illumination distribution is greater than the combined lengths of less uniform intensity at the two ends of the vertical illumination distribution.

18. The method of claim 14, wherein the less uniform intensity of at least one end of the horizontal illumination distribution of a light beam emitted by a first lighting unit overlaps with the less uniform intensity of at least one end of the horizontal illumination distribution of a light beam emitted by an adjacent lighting unit.

19. The method of claim 14, wherein the intensity of light within the region of overlap is similar to the intensity of the central region of the horizontal illumination distribution emitted by said first lighting unit, and similar to the intensity of the central region of the horizontal illumination distribution emitted by said adjacent lighting unit.

20. The method of claim 14, wherein the less uniform intensities of respective ends of the horizontal illumination distributions of adjacent lighting units of the plurality of lighting units overlap such that, in at least a majority of the overlap, the less uniform intensities of the respective ends add to form the 1.0 normalized illumination intensity value.

* * * * *